109-49.5 SR
5/5/87 OR 4,662,289

United States Patent [19]

Harder

[11] Patent Number: 4,662,289

[45] Date of Patent: May 5, 1987

[54] PROTECTIVE WALL FOR STRUCTURES

[75] Inventor: Josef Harder, Regensberg, Switzerland

[73] Assignee: Bauer Kassenfabrik AG, Rumlang, Switzerland

[21] Appl. No.: 826,493

[22] PCT Filed: Apr. 24, 1985

[86] PCT No.: PCT/CH85/00064

§ 371 Date: Dec. 19, 1985

§ 102(e) Date: Dec. 19, 1985

[87] PCT Pub. No.: WO85/05143

PCT Pub. Date: Nov. 21, 1985

[30] Foreign Application Priority Data

Apr. 28, 1984 [CH] Switzerland ..... 2059/84

[51] Int. Cl.[4] ..... E06B 9/00

[52] U.S. Cl. ..... 109/49.5; 109/33; 109/80

[58] Field of Search ..... 109/29, 33, 49.5, 80, 109/82–84

[56] References Cited

U.S. PATENT DOCUMENTS 137,456 4/1873 Little ..... 109/29

FOREIGN PATENT DOCUMENTS 212281 10/1908 Fed. Rep. of Germany ..... 109/29

*Primary Examiner*—Carl D. Friedman
*Assistant Examiner*—Naoko N. Slack
*Attorney, Agent, or Firm*—Karl F. Ross; Herbert Dubno

[57] ABSTRACT

To protect a construction against terrorist acts, in particular explosive attacks, a protective wall requiring considerable time for destruction is placed in front of it. This protective wall consists of a row of pillars from which are suspended a support net (4) and shielding elements (5) in the form of a box structure constituting a closed suspended wall (H1), attached by hooks (16) to the net. Each shielding element (5) comprises an armoured front plate (12) and a filling in the form of an inflammable material (13) in which igniting devices (14) are embedded, being triggered under the effect of the firing of the explosives or other means of attack, thus setting fire to the inflammable material (13). The flames and fumes thus produced prevent the terrorists from proceeding further.

5 Claims, 5 Drawing Figures

PROTECTIVE WALL FOR STRUCTURES

CROSS REFERENCE TO RELATED APPLICATIONS

This is a national phase application corresponding to PCT/CH85/00064 filed Apr. 24, 1985 and based upon a Swiss national application No. 2059/84--0 filed Apr. 28, 1984 under the International Convention.

FIELD OF THE INVENTION

The invention relates to an arrangement for the protection of buildings from terrorist attacks, in particular attacks using explosives, with a protective wall placed before the building.

BACKGROUND OF THE INVENTION

With certain buildings, for example power stations, radio and television stations, pylons for high-voltage lines, military installations or the like, there exists today an increasing danger of acts of terror for political reasons. Hitherto known protective devices for such installations have included relatively high barbed-wire fences or concrete walls, erected at relatively great distances of, for example, about 100 m from the outer wall of the endangered building or construction. However, these obstacles can be overcome relatively quickly by terrorists with special tools, especially by blowing them up, so that the time for alerting the police and their arrival at the scene of the crime is too short to prevent a local destruction of the outer wall of the building, the forced entry of the terrorists into the building, their actual destructive work in the interior of the building and their escape. In addition, there is often no possibility of erecting a protective wall at a considerable distance from the facade wall of the building owing to the lack of space at the locality. Sufficient security for the prevention of logistically carefully prepared acts of terror is thus in most cases not provided for at all.

OBJECT OF THE INVENTION

The object of the invention is to overcome the previously-mentioned disadvantages of the known protective devices, and to provide a protective arrangement which can be placed before the outer wall of the building and cannot be overcome without difficulty and hence relatively great expenditure of time by the terrorists, so that the time required to alert the police and for their timely appearance at the scene of the crime is maximized and prevention of the actual terror attack aimed at the building can be ensured.

SUMMARY OF THE INVENTION

Accordingly, the invention causes a delay in a terror attack by the generation of smoke and fumes. To this end, the protective wall comprises a combustible mass, in which ignition devices are embedded which are capable of being set off by a bomb explosion through a deformation of the protective wall, and, for setting off and, therewith, setting on fire the combustible mass, contain in each case coordinated amounts of two compounds or elements separated from each other and reacting only by mutual contact exothermically chemically together.

According to the invention acts of terror to overcome the protective wall are usually made practically impossible and even the most highly developed professional attack is thwarted through the intense heat and generation of smoke by means of the combustible mass set ablaze by means of the ignition device.

Penetration is delayed to such an extent that even if the protective wall is at last overcome by the terrorists, the actual terror attack on the intended object can be prevented because the police are alerted in time owing to the relatively great expenditure of time required for the local destruction of the protective wall with sufficient safety to the perpetrators.

Because of the far greater effectiveness of the protective wall according to the invention, the gain of time obtainable by using a relatively great distance between protective wall and facade of the building rather pales into insignificance. Therefore, the protective arrangement according to the invention can also be deployed there where the local space conditions do not make such a great protective distance possible; this is particularly the case when the protective wall is composed of two or more suspended walls which are self-contained and formed of armor plates and arranged one behind the other.

BRIEF DESCRIPTION OF THE DRAWING

Further features and advantages of the protective wall according to the invention emerge from the following description of an embodiment of the invention, reference being made to the accompanying schematic drawing. In the drawing.

SPECIFIC DESCRIPTION

Figure 1:
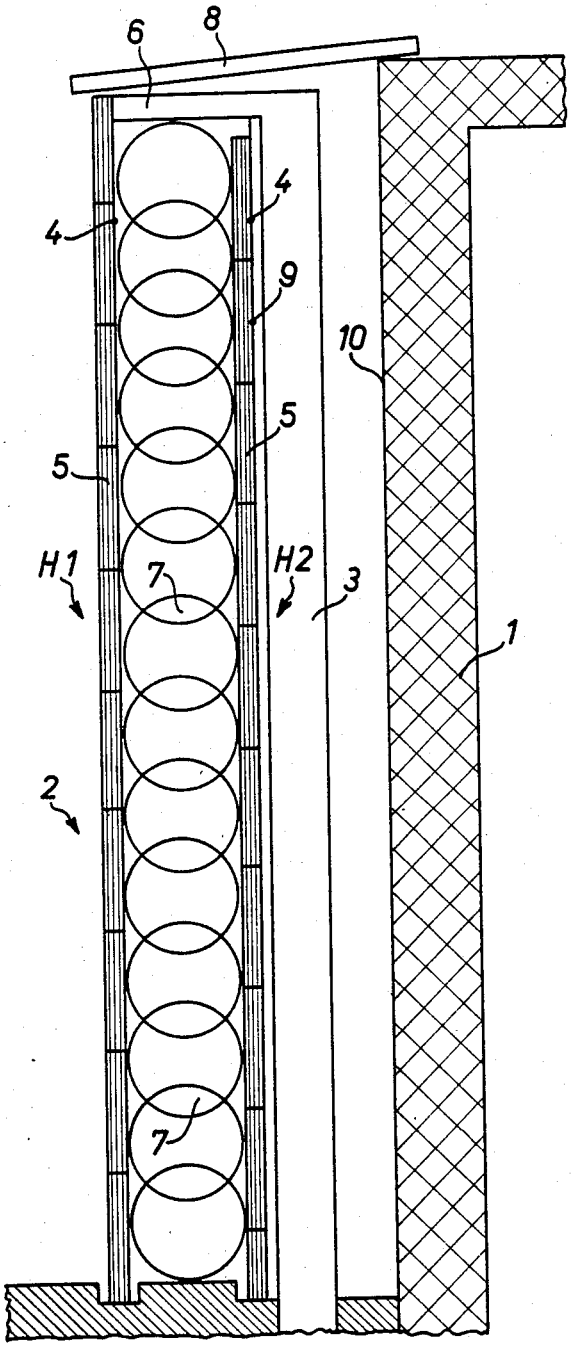
FIG. 1 shows the protective wall of the arrangement in a vertical cross-section.

In FIG. 1 a vertical outer wall of the building to be protected, e.g. a power station, is indicated by 1. The wall 1 is located at a relatively short distance behind a vertical protective wall, indicated generally by 2. The protective wall 2 is composed essentially of supporting pillars 3, two support nets 4 hanging thereon, and armor elements 5 hanging therein. The supporting pillars 3 are arranged in a row running at least approximately parallel to the outer wall 1 of the building, and are provided on their upper ends together with the same brackets 6 jutting forward, onto which in each case one support net 4 is hung in two vertical planes parallel to each other. In this manner, two vertical walls are formed parallel to each other by the two support nets 4 and the armour elements 5 hanging therein. The armour plates, placed together with horizontal and vertical joints, define two self-contained suspended walls H1 and H2 (see also FIG. 3 with the front suspended wall H1). The cavity between these two suspended walls is filled with rolls of barbed wire 7. By means of a small, forward-sloping roof 8, the protective wall 2, which is here, for example, about 1 m thick and with its rear wall surface 9 at a distance of about 1 m from the facade 10 of the outer wall 1 of the building, is protected against atmospheric rainfall.

Figure 2:
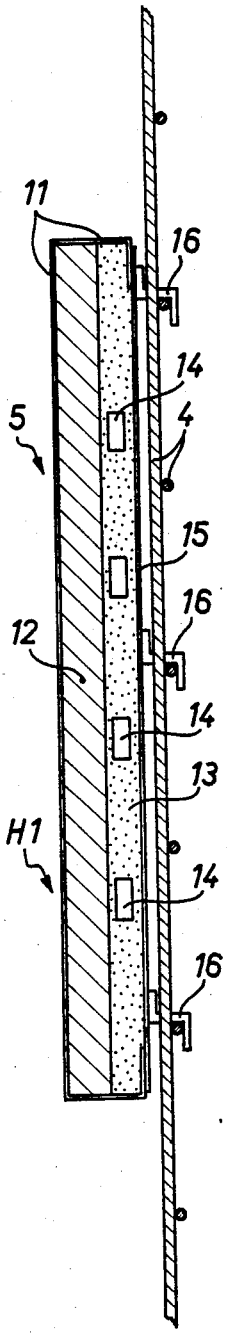
FIG. 2 shows an armor element of the protective wall as in FIG. 1 hanging in the accompanying support net, on a larger scale in a vertical cross-section.

As in FIG. 2, each armor element 5 is composed of a square-shaped, steel-plate box 11, a front-side armour plate 12 appropriately set in its cavity, and a combustible mass 13, filling the rest of the rear of the box cavity, as well as several ignition devices 14 for setting it on fire; the devices 14 are embedded in the combustible mass 13.

The mode of action of an individual ignition devices 14 will be illustrated in greater detail later with reference to FIG. 4; here it need only be stated that this ignition device produces a high temperature in a second by an exothermic action, i.e. a chemical reaction of two chemical compounds giving off heat, and thereby quickly sets fire to the combustible mass 13 surrounding the device, whereby the combustion immediately produces a great flame heat and at the same time strong smoke fumes.

The sheet-steel box 11 is closed by a rectangular sheet-steel plate 15 welded onto its rear. The armor element 5 is provided with hook-like hangers 16 welded onto the rear of the sheet-steel plate 16 and hung thereby in the support net 4. The thickness of an armor element 5 amounts to here in the exemplified embodiment according to FIG. 2 ca. 80 mm.

Figure 3:
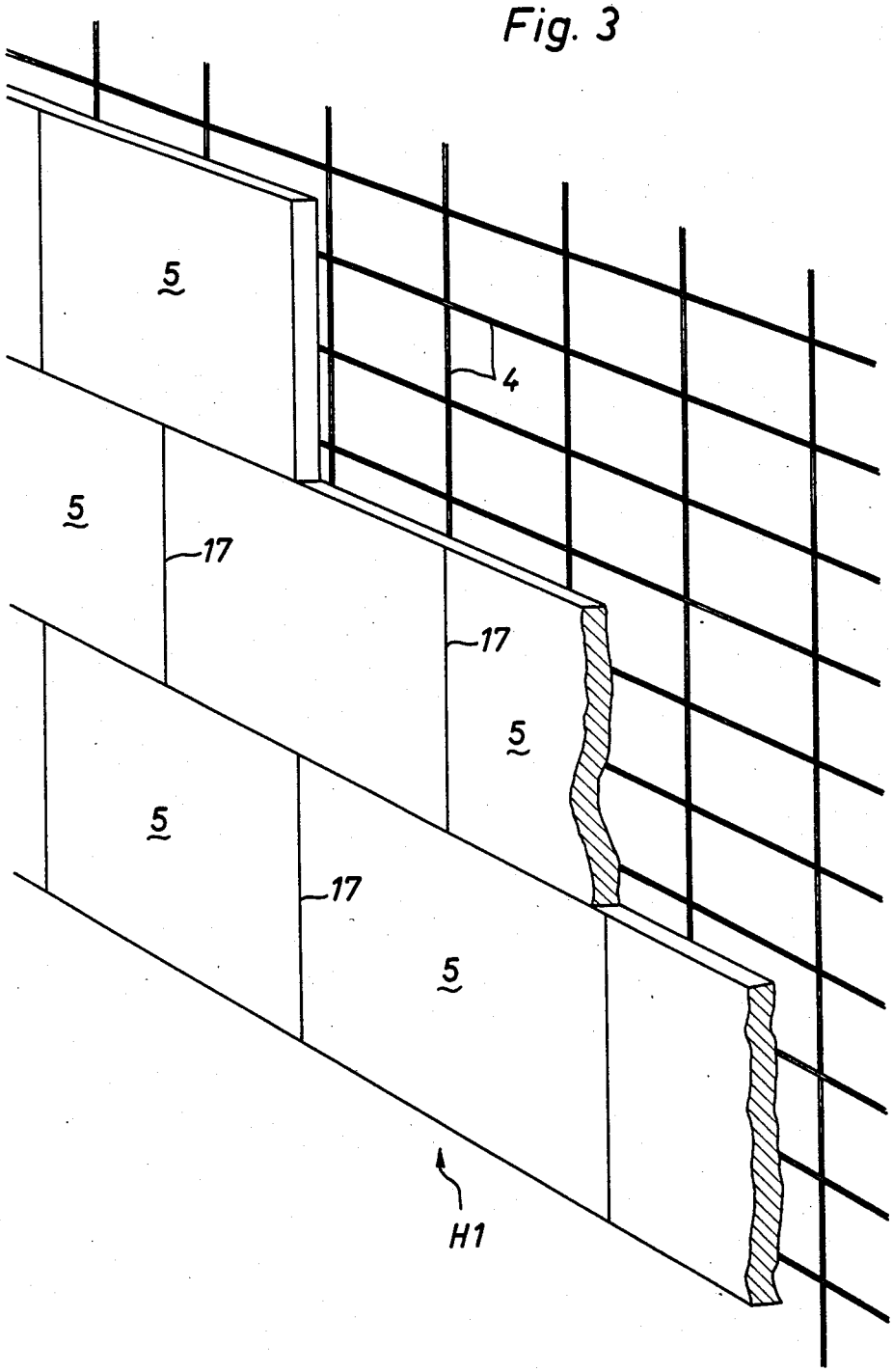
FIG. 3 shows a frontal section out of the protective wall as in FIG. 1, in a three-dimensional frontal view.

As in FIG. 3, the armor elements 5 are arranged in horizontal running rows one over the other. The armor elements 5 are here the same as one another and their joints 17 are offset relative to one another from row to row. The length of an armor element 5 amounts to here as in FIG. 3, for example, ca. 2 m, its height e.g. ca. 1 m. FIG. 3 also shows that, and how, a self-contained front suspended wall H1 is built up from the front supporting net 4 and the armor element 5 hanging thereon (compare also FIG. 1 with FIG. 3).

Figure 4:
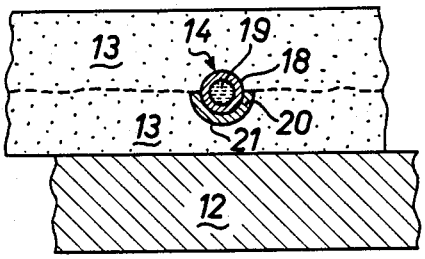
FIG. 4 shows an ignition device embedded in the combustible mass as in FIG. 2, in a vertical cross-section.
Figure 5:
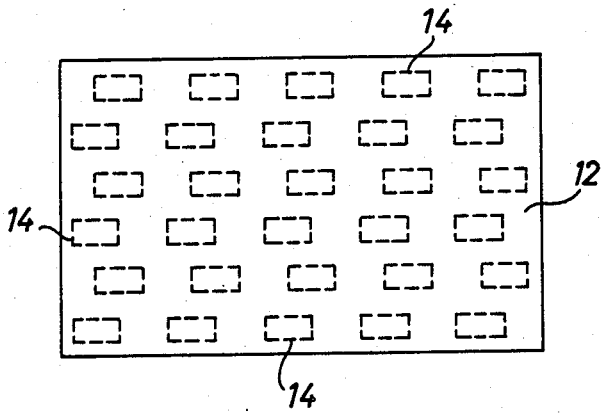
FIG. 5 shows an armour plate as in FIG. 2 with ignition devices as in FIGS. 2 and 4 arranged over its surface, in a frontal top plan view.

FIG. 4 illustrates how an individual ignition device, generally indicated at 14, is embedded in the combustible mass 13. The ignition device 14 is here composed of, for example, a glass ampoule 18 containing a liquid chemical 19 and another chemical compound 20 of e.g. powder or solid form.

The two chemical compounds 19 and 20 are substances between which a great specific combining ability, i.e. a high chemical affinity exists, so that when they are brought together a rapid exothermic chemical reaction takes place and a relatively large amount of heat is liberated immediately and, thereby, a relatively high temperature is quickly produced; this is the ignition temperature for the combustible mass 13 and, of course, depends not only on the kind of materials concerned, but also upon the temperature, pressure and on the quantitive relationship of the reactants.

When terrorists attack the protective wall 2 (see FIG. 1) with explosives, at least one ampoule 18 bursts in the vicinity of the exploding charge owing to deformation of the armor plate 12 impacted thereby; this is ensured since the length of each ampoule is a great deal more than its diameter, i.e. the ampoule is relatively slender. Upon the bursting of the ampoule 18, the contents thereof, i.e. the liquid compound 19, comes into contact with the solid compound 20 in the direct vicinity of the ampoule, so that the required chemical reaction between the two materials 19/20 for the ignition of the combustible mass 13 is produced instantaneously. Immediately, the combustible mass 13 which can be composed to a large extent of cut up old car tires, thus set on fire, produces large amounts of smoke fumes, also great heat, which hinders and thereby considerably delays the continuation of the activity of the terrorists.

A terrorist attack by means of explosives is, then, interrupted in its initial stage approximately as follows:

When the front suspended wall H1 of the protective wall 2 (see FIG. 1) is partially demolished and the combustible mass 13 is burning, the terrorist takes cover on the ground; then follows the explosion of the charge; by the time the terrorist has gotten up from his place of cover, however, the mass is burning in the inside of the wall. Then, however, the terrorist has the problem of having to extinguish the fire (e.g. by means of a hand fire extinguisher) in order to be able to continue the attack.

It is true that the burning of the combustible mass 13 is only and first started by the destruction of an armour element 5, i.e. the sheet-steel box 11 and the armour plate 12 placed therein and belonging thereto, but then when an armour element 5 is destroyed, for example, through the explosion, the combustible mass 13 is set afire in seconds, for example, in two seconds, by the ignition device 14. Once the mass 13 begins to burn, it is only extinguishable with difficulty.

If an explosive charge is used in the terror attack, then at least one of the armour plates 12 is torn or at least bent, i.e. very strongly deformed. Then at least one of the ampoules 18 found in the armour element 5 is broken and liquid then escapes out of it and reaches the powdery, i.e. solid compound 20. If, however, an oxygen lance or a welding torch is used in the terror attack, then the combustible mass 13 is in any case set on fire by the locally applied heat; the ignition device 14 which are then set off act as ignition boosters. The ignition device 14 is of particularly great importance for a terror attack by means of explosives, particularly as explosives are the most commonly employed accessories for serious acts of terror.

The embedding of the ignition device 14 in the combustible mass 13 takes place for example as follows:

In the at first only partially filled combustible mass 13 in the sheet-steel box 11 (see FIG. 2), a deepening 21 is formed in which, then, the amount of the solid compound 20 is pressed in (see FIG. 4). Thereupon, the ampoule 18 filled with the amount of liquid compound 19 is for its part pressed into the solid compound 20, so that it is approximately half cylindrically enclosed lengthwise by the latter on the front side exposed to the terror attack. Finally, the ampoule 18 is covered at its rear side, i.e. on the side towards the power station facade, with the remaining combustible substance 13 to be used (see FIG. 4).

Nowadays, terrorists work with diamond-bit drills, welding torches, oxygen lances or explosives. The repulsion of the attacks using explosives was described in detail above. In the following, the repulsion of terror attacks using oxygen lances in particular is given in more detail; however, the following example of operation on the step-by-step advance of the terrorists and their therewith constantly increasing impediment is in principle also of relevance for attacks using explosives.

In an act of terror with an oxygen lance, the armor plate 12 of an armor element 5 of the lowest row of elements on the front suspended wall H1 would be, at the worst, pierced. Thereby, however, one of the ignition devices 14 would be set off, whereby the combustible mass 13 would be set on fire immediately, causing a strong generation of flames and fumes. The similar would also be applicable to attacks with a welding torch. To be able to slip through, the relatively small hole in the armor plate 5 must be enlarged a great deal by the terrorists. In this, however, they will at least be strongly impeded by the flames and the escaping hot fumes, which delays or prevents penetration of the second, rear suspended wall H2.

For the party affected by the act of terror, the first and most important concern is to gain as much time as possible in order to ensure with sufficient safety the timely arrival on the scene of the police.

In the case of a terrorist succeeding in penetrating between two neighboring ignition devices 14 when attacking the front suspended wall H1 by means of a diamond-bit drill, the hole would then have to be enlarged a great deal to be able to slip through. At least one of the ignition devices 14 lying in the area of the enlargement of the through bore hole would, however, be set off.

Even with a partial destruction of also the second, rear-side suspended wall H2, the additional generation of flames and fumes with its increasing irritation, inducement of nervousness and resulting fatigue of the terrorists, can prevent a professionally, logistically prepared terror acts before the actual target, i.e. the outer wall of the building, is reached. By then, however, the police responsible for the buidling and alerted earlier have usually arrived at the scene. Should, however, the police still be on the way, the actual terror attack on the building itself will begin so late that there is still a relatively great possibility of rendering the physically and morally more or less strongly hampered terrorists harmless and arresting them during their attack on the outside wall 1 of the building.

By means of a careful mutual coordination of the distance between the two suspended walls H1 and H2 with the distance between the protective wall 2 and the outer wall 1 of the building (see FIG. 1) in conjunction with the choice of the wall thickness for the two suspended walls, as well as the kind and amount of combustible mass 13 employed, the gain of time, until the timely arrival of the police, through the increased impediment of the terrorists can be still further optimized.

For the terrorists must, if they are to succeed in overcoming the first suspended wall H1, get nearer to this to be able to tackle also the second suspended wall H2 with the oxygen lance or the welding torch, and they must, provided that they should succeed in overcoming this, then still advance under ever increasingly difficult spatial and physical conditions to be able to even reach the outer wall 1 of the building at all.

It is advantageous for the protective wall 2 to be provided with end plates at its two small sides extending to the facade 10 of the outer wall of the building and upwards to the roofing 8 (see FIG. 1).

Being that the cavity between the two suspended walls H1 and H2 is filled with rolls of barbed wire 7 (see FIG. 1), overcoming the protective wall 2 is made additionally complicated for the terrorist attack and therewith further delayed.

The police alarm system is already known and therefore not represented in the drawings for clarity's sake. For example, a vibration feeler serving as mechanical impulse receiver, triggering the alarm at the police station by way of an impulse converter, which converts the mechanical impulses into electric ones, comes here into consideration. Other transmitters, such as for example thermofeelers and/or special microphones might equally be used.

Several deviations from the protective arrangement previously described with the aid of the drawings are possible. Thus, instead of arranging two suspended walls behind each other, depending on the importance of the object to be protected, three or, on the other hand, only a single one thereof could be provided. Instead of having the row of supporting pillars running parallel to the facade of the building, it could also—depending on the local structural conditions—deviate from the parallel extension to a greater or lesser extent. Instead of providing a single supporting net for the construction of the supported wall, several net tracks could be hung on the supporting pillars at the respective vertical level. Instead of inserting only a single armour plate in the armour element, also two or more per element could be arranged next to, above or behind one another therein.

The invention is, hence, by no means bound to the specific embodiments of the protective arrangement previously described with the aid of the drawings, on the contrary, the details of the construction in the framework of the invention can be varied.

I claim:

1. An antiterrorist protective wall adapted to be disposed ahead of a structure subject to attack, said wall comprising:

a row of supporting pillars running at least approximately parallel to said structure;

at least one support net suspended from said pillars and lying substantially in a vertical plane; and armor elements hung from said net to define a self-contained suspended wall member, each of said armor elements comprising:

housing means forming a box-type compartment, an armor plate disposed at a front side of said compartment turned away from said structure, a filling of a combustible mass in said compartment rearwardly of said armor plate and capable upon ignition of generating high temperature, smoke and fumes impeding a terrorist attack, and ignition devices embedded in said combustible mass, each of said ignition devices comprising two coordinated amounts of mutually exothermically reactive substances normally separated from one another, but coming into contact upon such attack to react and generate a temperature sufficient to ignite said mass.

2. The antiterrorist protective wall defined in claim 1 wherein said supporting pillars are provided on their upper ends with brackets extending forwardly and upon which a pair of parallel support nets are suspended, said support nets being spaced apart from one another and each carrying said armor elements to define a respective self-contained suspended wall member.

3. The antiterrorist protective wall defined in claim 2 wherein the space between said wall members is filled with rows of barbed wire.

4. The antiterrorist protective wall defined in claim 1 wherein said housing means closes said compartment on all sides.

5. The antiterrorist protective wall defined in claim 1 wherein each of said ignition devices comprises an ampule containing one of said substances in the form of a liquid compound, the other of said substances being a solid compound enveloping said ampule on a front side thereof.

* * * * *